US011732538B2

(12) United States Patent
Hosie et al.

(10) Patent No.: US 11,732,538 B2
(45) Date of Patent: Aug. 22, 2023

(54) SYSTEM AND METHOD FOR FULL BORE TUBING HEAD SPOOL

(71) Applicant: Baker Hughes Energy Technology UK Limited, Aberdeen (GB)

(72) Inventors: Stanley Hosie, Houston, TX (US); Brian Craig, Aberdeen (GB)

(73) Assignee: Baker Hughes Energy Technology UK Limited, Aberdeen (GB)

( * ) Notice: Subject to any disclaimer, the term of this patent is extended or adjusted under 35 U.S.C. 154(b) by 0 days.

(21) Appl. No.: 17/390,017

(22) Filed: Jul. 30, 2021

(65) Prior Publication Data

US 2022/0034180 A1 Feb. 3, 2022

(30) Foreign Application Priority Data

Jul. 31, 2020 (GB) ..... 2011951

(51) Int. Cl.

| | |
|---|---|
| ***E21B 33/04*** | (2006.01) |
| ***E21B 23/03*** | (2006.01) |
| ***E21B 19/22*** | (2006.01) |
| ***E21B 29/00*** | (2006.01) |
| ***E21B 33/06*** | (2006.01) |

(52) U.S. Cl.

CPC ..... *E21B 23/03* (2013.01); *E21B 19/22* (2013.01); *E21B 29/002* (2013.01); *E21B 33/04* (2013.01); *E21B 33/0422* (2013.01); *E21B 33/06* (2013.01)

(58) Field of Classification Search

CPC ..... E21B 33/04; E21B 33/0422

See application file for complete search history.

(56) References Cited

U.S. PATENT DOCUMENTS

| | | | | |
|---|---|---|---|---|
| 5,544,707 | A * | 8/1996 | Hopper | E21B 34/02 166/368 |
| 5,975,210 | A | 11/1999 | Wilkins | |
| 6,595,297 | B2 | 7/2003 | Dallas | |
| 6,715,554 | B1 | 4/2004 | Cunningham | |
| 8,196,649 | B2 | 6/2012 | Allen et al. | |
| 8,590,625 | B1 | 11/2013 | Smith | |
| 9,376,872 | B2 | 6/2016 | June | |

(Continued)

FOREIGN PATENT DOCUMENTS

| | | |
|---|---|---|
| EP | 1707737 | 10/2006 |
| WO | 2004/083598 | 9/2004 |

OTHER PUBLICATIONS

"Subsea Slenderwall Drill-through Spool Tree System," Apr. 8, 2005, https://www.hartenergy.com/exclusives/subsea-slenderwall-drill-through-spooltree-system-21481, 3 pages.

(Continued)

*Primary Examiner* — Giovanna Wright

(74) *Attorney, Agent, or Firm* — Hogan Lovells US LLP

(57) ABSTRACT

A system includes a tubing head spool (THS) installed in a non-plugged wellbore, the THS having a bore diameter to permit passage of one or more wellbore components corresponding to one or more wellbore components that pass through an associated blowout preventer (BOP). The system also includes an orientation sleeve arranged within the THS and installed, the orientation sleeve being positioned and aligned within the THS via one or more engagement features mating with one or more orientation features within the bore.

20 Claims, 7 Drawing Sheets

(56) References Cited

U.S. PATENT DOCUMENTS

| | | | |
|---|---|---|---|
| 2003/0051878 | A1 | 3/2003 | DeBerry |
| 2004/0104024 | A1 | 6/2004 | Kent |
| 2004/0231835 | A1 | 11/2004 | Thai |
| 2008/0017383 | A1 | 1/2008 | Minassian |
| 2020/0217165 | A1 | 7/2020 | Robottom |

OTHER PUBLICATIONS

Dril-Quip, "HorizontalBore Subsea Tree Low Cost Solutions with Dril-Quip Reliability," 8 pages.

* cited by examiner

SYSTEM AND METHOD FOR FULL BORE TUBING HEAD SPOOL

CROSS REFERENCE TO RELATED APPLICATIONS

This application claims the benefit of GB Patent Application No. 2011951 filed on Jul. 31, 2020, titled "TUBING HEAD SPOOL AND METHOD OF DRILLING A WELL USING THE TUBING HEAD SPOOL," the full disclosure of which is hereby incorporated herein in its entirety by reference.

BACKGROUND

1. Field of the Disclosure

The present disclosure relates to subsea operations. Specifically, the present disclosure relates to systems and methods for tubing head spools with drilling and completion operations.

2. Description of Related Art

Oil and gas operations may be conducted in subsea environments where components are installed on a sea floor from a surface location, such as a vessel or floating platform. Systems used in subsea operations may be heavy, experience extreme temperature or pressure scenarios, and be challenging to move between locations. As a result, reducing the number of components utilized or reducing the number of "runs" or "trips" to the sea floor is desirable. Certain drilling and/or completion operations use a tubing head spool (THS) to orientate a tubing hanger (TH) within a well system. The TH is sited on the landing shoulder of a THS to support the tubing string, to provide a seal between the THS and the TH, and make-up of various components to a subsea tree. Furthermore, the THS may be used to align production and annulus flow paths, among other uses. Typical wellbore arrangements include a blowout preventer (BOP) which is installed on the wellhead for drilling operations and the THS for completion operations, but installation takes multiple steps where the well is plugged, the BOP is removed from the wellhead high-pressure housing, the THS is installed, and then the BOP is reinstalled prior to removal of the plug. These extra steps take significant time and cost operators significant capital, which may reduce the desirability and/or profitability of recovery for certain reservoirs.

SUMMARY

Applicants recognized the problems noted above herein and conceived and developed embodiments of systems and methods, according to the present disclosure, for subsea operations.

In an embodiment, a wellbore system includes a tubing head spool (THS) having a THS bore, the THS bore being a full access bore having a diameter to facilitate passage of one or more wellbore components. The wellbore system also includes a blowout preventer (BOP) associated with and connected to the THS, the BOP being installed after the THS and without plugging a well prior to installation, the BOP having a BOP bore, the BOP bore being a full access bore permitting passing of the one or more wellbore components. The wellbore system further includes an orientation sleeve arranged within the THS and installed through the BOP, the orientation sleeve having at least one engagement feature that interacts with at least one orientation feature formed along the THS bore, the at least one orientation feature positioning the orientation sleeve in a predetermined configuration.

In another embodiment, a method includes installing, prior to installation of a blowout preventer (BOP), a tubing head spool (THS). The method also includes landing, on a well after installation of the THS, the BOP. The method further includes running, through both the THS and the BOP, one or more strings to conduct a wellbore operation. The method includes installing, through the BOP, an orientation sleeve within the THS. The method also includes landing, within the BOP, a tubing hanger.

In an embodiment, a system includes a tubing head spool (THS) installed in a non-plugged wellbore, the THS having a bore with a diameter to permit passage of one or more wellbore components corresponding to one or more wellbore components that pass through an associated blowout preventer (BOP). The system also includes an orientation sleeve arranged within the THS, the orientation sleeve being positioned and aligned within the THS via one or more engagement features mating with one or more orientation features within the bore.

BRIEF DESCRIPTION OF DRAWINGS

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

DETAILED DESCRIPTION

Figure 1:
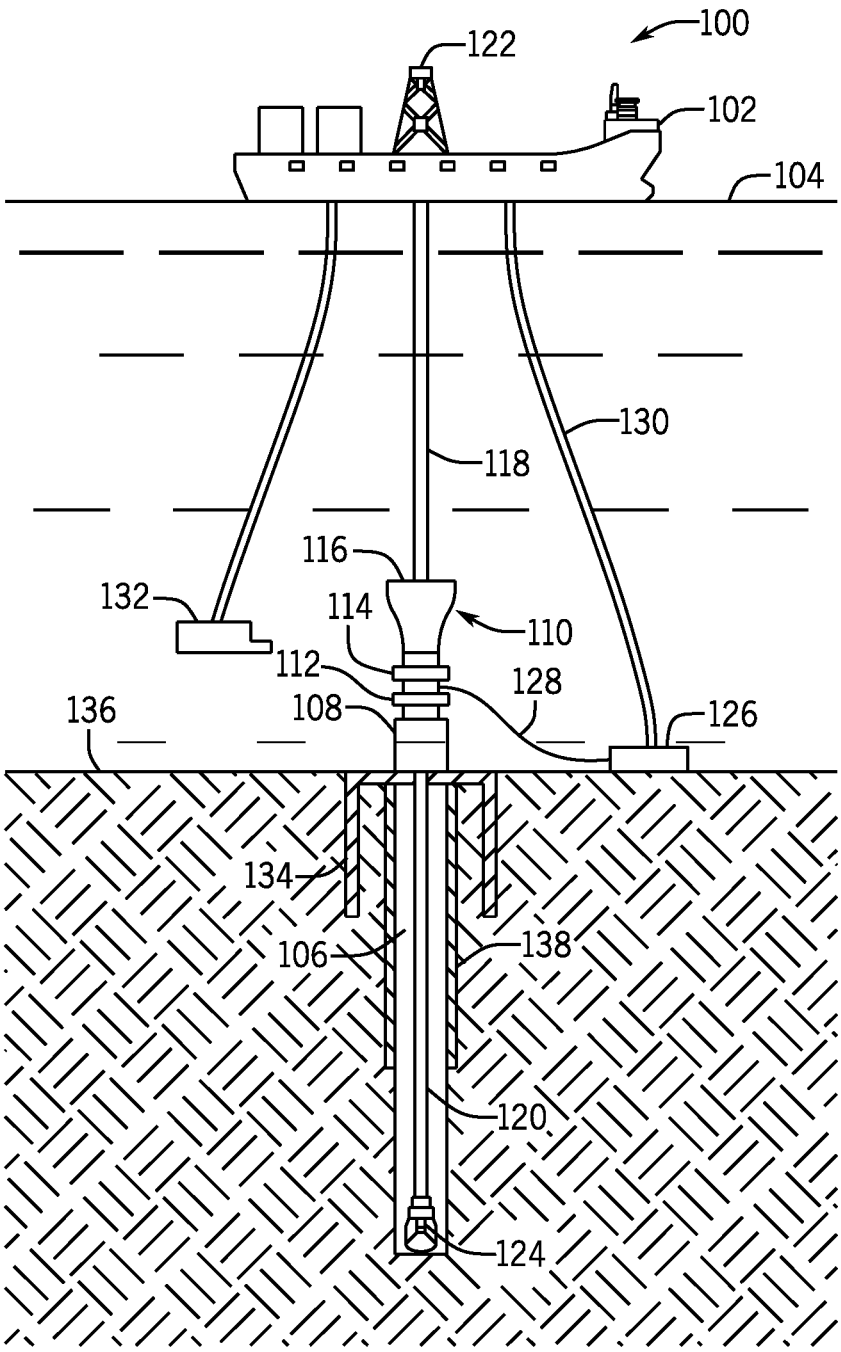
FIG. 1 is a schematic side view of an embodiment of an offshore drilling operation, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions. It should be further appreciated that terms such as approximately or substantially may indicate +/− 10 percent.

Embodiments of the present disclosure are directed toward a tubing head spool (THS) for providing full bore access. Further embodiments are directed toward an orientation sleeves positioned within the full bore of the THS. Various embodiments of the present disclosure are directed toward one or more systems and methods for reducing a number of trips or runs for a wellbore, which may be a subsea system, by enabling operations to be conducted through both a THS and a blowout preventer (BOP). Such a system may enable installation of the THB to a wellhead and then further installation of the BOP. Thereafter, or prior to installation of the BOP, an orientation sleeve may be arranged within a bore of the THS. The orientation sleeve, in various embodiments, may be utilized to support production tubing (e.g., production casing) for well recovery operations. In certain embodiments, drilling or other operations may be conducted through the BOP and THS. Providing clearance to conduct one or more drilling, casing, completion, inspection, or otherwise downhole operations through both the BOP and THS may reduce one or more runs or operations, which may decrease an operating cost for recovery from the wellbore.

Embodiments of the present disclosure are directed toward the THS having a bore that is arranged to receive an orientation sleeve. The bore may have a diameter (e.g., an inner diameter, a clearance, etc.) sufficient to permit passage of components such as drill bits, wear bushings, casing strings, hangers, seals, and the like. As a result, these operations may be run through the THS and landed in the wellhead without removing of the THS. Systems also provide for more efficient and streamlined operations because when all necessary components have been run through the wider bore of the tubing head spool, the orientation sleeve may then be fitted in the bore of the tubing head spool. The orientation sleeve, as noted above, may then be used to support production tubing or the like. In this manner, operations utilizing the systems and methods of the present disclosure eliminate one or more typical steps in wellbore operations, such as eliminating the need to remove the BOP to fit the THS. Removal of these one or more steps may save days in the well installation schedule and enable a subsequently run tubing hanger to be landed and orientated correctly within the body of the tubing head spool. Reducing a number of steps may reduce time and costs associated with wellbore operations, which may make recovery from the reservoir more attractive to operators.

Various embodiments of the present disclosure are directed toward the THS having a bore including one or more features to retain an orientation sleeve. In embodiments, the bore has a diameter that is wider than one or more components such as drill bits, wear bushings, casing strings, hangers, seals, and the like to enable components to be run through the THS without removal from the well to save days of installation time, as well as costs. However, upon installation of the orientation sleeve, such components may no longer pass through the THS due to an orientation sleeve inner diameter. In one or more embodiments, the one or more features may include a slot or a groove to engage one or more corresponding engagement features, such as a key, on the orientation sleeve to secure the orientation sleeve inside the bore of the THS after the components have been run through. In at least one embodiment, that orientation sleeve is not installed until after the various components have been run through the THS and various wellbore operations are complete or substantially complete (e.g., complete to the point where the installation of the orientation sleeve is desirable). When installed in the THS, the orientation sleeve seals and locks to the THS to retain pressure and accommodate up thrust loads. The orientation sleeve may include internal landings, such as one or more engagement and sealing surfaces, enabling a subsequently run tubing hanger to be landed, sealed, and orientated correctly (e.g., in an orientation desired by the operator) within the body of the THS.

Various systems and methods of the present disclosure are further directed toward drilling a subsea well that includes fitting a THS to the well, running one or more strings, such as a production casing string, through the bore of the THS, fitting an orientation sleeve to the bore of the THS and landing a tubing hanger in the orientation sleeve.

Systems and methods of the present disclosure may be utilized to overcome one or more deficiencies with current wellbore operations. For example, the THS may be used to orientate a tubing hanger within a well system for reliable make-up of connections, such as electrical and/or hydraulic connections, to one or more subsea systems, such as a subsea tree. Furthermore, the tubing hanger may facilitate alignment of production and annulus flow paths between the well and the tree, while also providing an annulus flow path that may include one or more isolation devices. However, traditional drilling operations are generally executed through a BOP due to the configuration of the various traditional THSs having bores that are too small to fit various components, such as drill bits. As a result, in order to run and lock a THS, the BOP and marine riser are first removed from the high-pressure housing on the well. Removal adds time and complexity to the operation, as removal includes setting plugs and swapping out the marine riser contents to seawater to allow the BOP to be disconnected. Thereafter, the rig may be moved to the side or the marine riser and BOP are recovered to the rig to allow the THS to be run and locked to the high-pressure housing. Next, the BOP and marine riser are reconnected to the high-pressure housing, the contents of the riser are circulated back to mud/completion brine, and then the previously installed plugs are recovered. The well is then drilled for the lower completion through the bore of the THS. Depending on the water depth, the process of disconnecting the BOP, running and testing the THS, and then reconnecting the BOP and being in a position to continue with drilling the well can take several days which is significant in the cost and schedule of installing an offshore well. Systems and methods remove many of these steps, save runs to the sea floor, and provide a reduced cost and reduced time operation.

Various embodiments of the present disclosure are directed toward a THS with a bore providing full bore access and arranged to receive an orientation sleeve in the bore. Moreover, systems and methods may be directed toward orientation, locking, and sealing components within the bore to engage with the orientation sleeve to enable it to be secured inside the bore of the THS. In at least one embodiment, the components include one or more slots on the surface of the bore to engage with corresponding keys on the outside surface of the orientation sleeve. In various embodiments, the orientation sleeve has orientation features or components enabling a subsequently run tubing hanger to be orientated correctly, locked, and sealed within the body of the THS. In one or more embodiments, the sleeve orientation components include a helical groove on the inside surface of the removable orientation sleeve. Various embodiments may also be directed toward a method of drilling a subsea well that includes, at least in part, installing a THS to the well, running one or more strings through the bore of the THS, installing an orientation sleeve in the bore of the tubing head spool, and landing a tubing hanger in the orientation sleeve. In at least one embodiment, installing the orientation sleeve in the bore of the tubing head spool comprises engaging corresponding orientation, locking, and sealing components on the inside surface of the THS bore and the outside surface of the orientation sleeve. In at least one embodiment, landing the tubing hanger in the removable sleeve includes engaging the tubing hanger with orientation features in the removable orientation sleeve to orientate, lock, and seal the tubing hanger in the orientation sleeve.

Systems and methods of the present disclosure may further be directed toward one or more sidetrack drilling operations. In at least one embodiment, the BOP may be arranged on the THS, as noted above. The will may be plugged or otherwise shut in, for example by activating one or more kill operations. In various embodiments, tubing, such as production tubing, may be removed from the wellbore, such as removing the tubing from the tubing hanger. Thereafter, production casing may be cemented into place and a casing hanger packoff may be removed. In various embodiments, casing may then be cut and removed above the cement barriers, which is followed by installation of a whipstock. Thereafter, drilling out for production casing may commence with additional casing and completion being installed.

FIG. 1 is a side schematic view of an embodiment of a subsea drilling operation 100. It should be appreciated that one or more features have been removed for clarity with the present discussion and that removal or inclusion of certain features is not intended to be limited, but provided by way of example only. The drilling operation includes a vessel 102 floating on a sea surface 104 substantially above a wellbore 106. A wellbore housing 108 sits at the top of the wellbore 106 and is connected to a blowout preventer (BOP) assembly 110, which may include shear rams 112, sealing rams 114, and/or an annular ram 116. One purpose of the BOP assembly 110 is to help control pressure in the wellbore 106. The BOP assembly 110 is connected to the vessel 102 by a riser 118. During drilling operations, a drill string 120 passes from a rig 122 on the vessel 102, through the riser 118, through the BOP assembly 110, through the wellhead housing 108, and into the wellbore 106. It should be appreciated that reference to the vessel 102 is for illustrative purposes only and that the vessel may be replaced with a floating platform or other structure. The lower end of the drill string 120 is attached to a drill bit 124 that extends the wellbore 106 as the drill string 120 turns. Additional features shown in FIG. 1 include a mud pump 126 with mud lines 128 connecting the mud pump 126 to the BOP assembly 110, and a mud return line 130 connecting the mud pump 126 to the vessel 102. A remotely operated vehicle (ROV) 132 can be used to make adjustments to, repair, or replace equipment as necessary. Although a BOP assembly 110 is shown in the figures, the wellhead housing 104 could be attached to other well equipment as well, including, for example, a tree, a spool, a manifold, or another valve or completion assembly.

One efficient way to start drilling a wellbore 106 is through use of a suction pile 134. Such a procedure is accomplished by attaching the wellhead housing 108 to the top of the suction pile 134 and lowering the suction pile 134 to a sea floor 136. As interior chambers in the suction pile 134 are evacuated, the suction pile 134 is driven into the sea floor 136, as shown in FIG. 1, until the suction pile 134 is substantially submerged in the sea floor 136 and the wellhead housing 108 is positioned at the sea floor 136 so that further drilling can commence. As the wellbore 106 is drilled, the walls of the wellbore are reinforced with concrete casings 138 that provide stability to the wellbore 106 and help to control pressure from the formation.

As noted above, in at least one embodiment further installation of a THS from the configuration shown in FIG. 1 may involve removal of the BOP, moving the riser 118, recovery to the surface of various components, and the like. These steps may take rig time and cost significant amounts of money, which may reduce the overall profitability of the well and, in certain cases, may lead to decisions to not attempt to recover from the well. Systems and methods of the present disclosure may be directed toward enabling drilling, completion, recovery, or various other operations through a THS. The THS may be positioned such that installation may be downhole (e.g., closer to the bottom) than the BOP and may be installed prior to installation of the BOP, which may then enable operations through the THS and BOP without subsequent removal of the BOP to install the THS. Accordingly, systems and methods may be directed toward one or more components having features that provide improvements for performing wellbore operations.

Embodiments of the present disclosure may include a THS having a bore with one or more engagement features, such as orientation slots, on a surface of the bore. The engagement features may engage with corresponding orientation features of a later installed orientation sleeve, such as one or more corresponding keys, to orientate the sleeve within the THS. In various embodiments, the bore of the tubing head spool includes also includes one or more locking grooves and a sealing surface to lock and seal with the orientation sleeve. A bore of the orientation sleeve may include coupling features, such as a helical groove, to engage and orientate components installed inside the bore of the orientation sleeve such as a tubing hanger.

Figure 2:
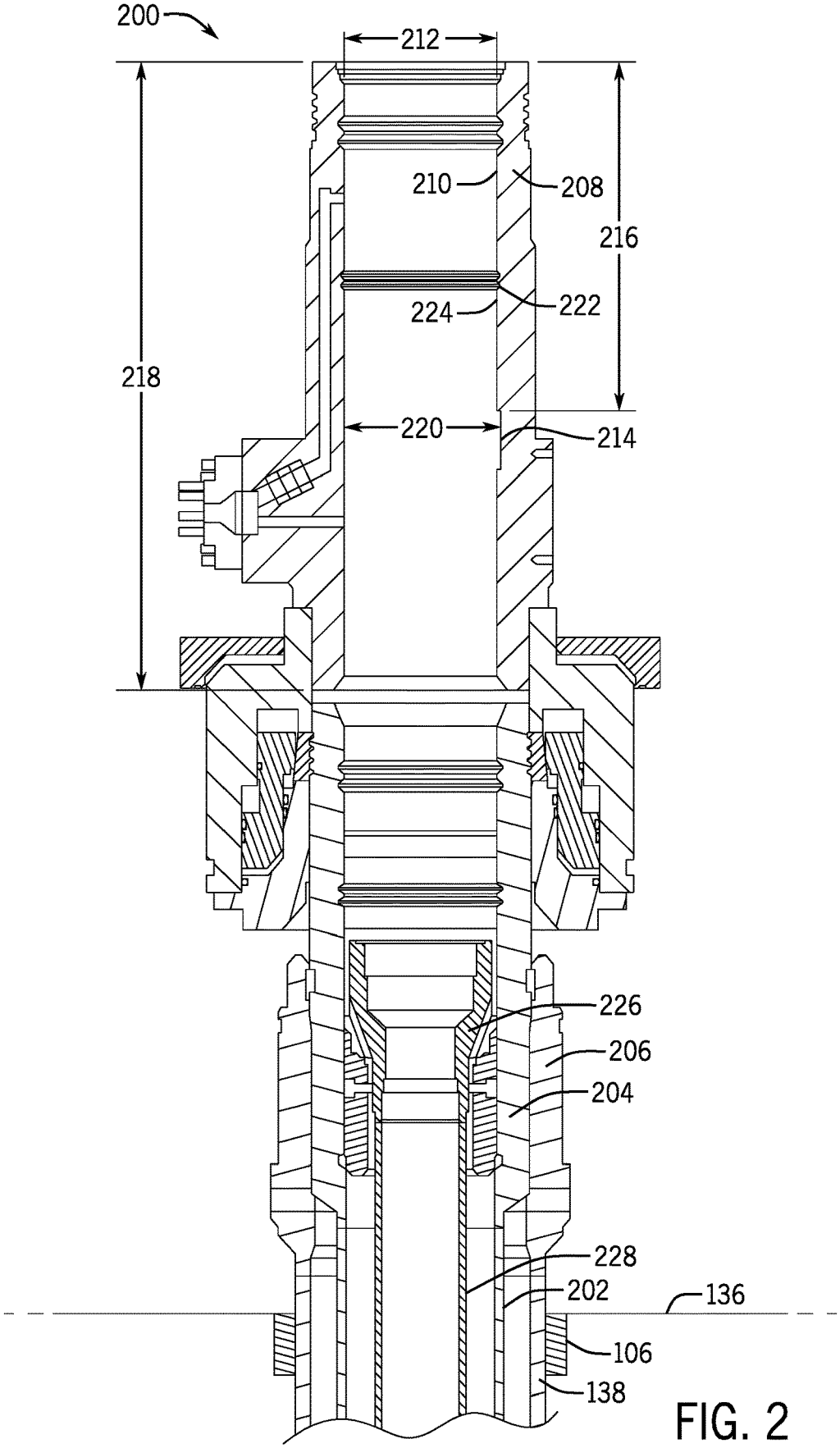
FIG. 2 is a schematic cross-sectional view of an embodiment of a well system, in accordance with embodiments of the present disclosure.

FIG. 2 is a schematic cross-sectional side view of an embodiment of a well system 200. The illustrated well system 100 is positioned at the sea floor 136 and includes the wellbore 106 with the casing 138, which may also be referred to as an outer well conductor, among other options. In this example, the casing 138 is cemented into place. A casing string 202 extends into an annulus formed by the casing 138 and includes a high pressure housing 204 that is landed on a low pressure housing 206. It should be appreciated that in one or more embodiments the respective housings 204, 206 may be considered to form at least a portion of the wellbore housing 108 or may be considered separate components.

In at least one embodiment, a tubing head spool (THS) 208 is run, orientated to a determined heading relative to a manifold or flow line, and then locked to the high pressure housing 204. The illustrated THS 208 includes a bore 210, which in this example has a bore diameter 212 particularly selected to enable passage of one or more downhole components, such as drill bits, wear bushings, casing strings, hangers, seals, and the like to be run through the bore 210 of the THS 208. As noted above, by providing the increased diameter 212, various operations may be conducted through the BOP (not pictured) and the THS 208 without removing the BOP to install the THS 208, thereby reducing rig time and costs associated with running different components between a rig and the sea floor. In at least one embodiment, the BOP will be arranged upstream of the THS 208, which in this configuration refers to operations where fluid is flowing into the well and/or where a tool in being moved from a surface location into the well.

Various embodiments of the present disclosure further include one or more features associated with the THS 208 that further enable various wellbore operations not currently permitted by present designs. In at least one embodiment, one or more orientation features 214 are arranged along the bore 210. The example shown in FIG. 2 includes slots or grooves as the orientation features 214, but it should be appreciated that various other features may also be utilized, such as shoulders, threads, bayonet fittings, and the like. Moreover, while a single slot is illustrated, it should be appreciated that various embodiments may include multiple slots, either positioned at different circumferential positions about the bore 210 and/or axially spaced along the bore 210.

In this example, the orientation features 214 are arranged at an orientation axial position 216, along an axial tubing head length 218. In various embodiments, the orientation features 214 are positioned at particularly selected locations based, at least in part, on one or more features of an orientation sleeve to be installed within the bore 210. As shown, the orientation features 214 extend into a body of the THS 208 such that the orientation features have a feature diameter 220 that is larger than the bore diameter 212. It should be appreciated that such a configuration may further facilitate operations of the THS with other components, such as drill bits and the like, because the orientation features 214 are not impeding or otherwise reducing the clearance within the bore 210. However, it should be appreciated that various embodiments may include orientation features 214 that extend into the bore 210 as long as such extensions are not so large as to block passage of additional components. As will be described below, in one or more embodiments the orientation features 214 will engage or otherwise interact with corresponding features of an orientation sleeve. Such interaction may facilitate alignment and locking of the orientation sleeve within the bore 210.

In at least one embodiment, the THS 208 further includes locking features 222 and a sealing surface 224. In this example, both the locking features 222 and sealing surface 224 are positioned axially higher than the orientation features 214. That is, the locking features 222 and the sealing surface 224 are arranged farther away from the sea floor 136 than the orientation features 214 in this example. It should be appreciated that such an arrangement is by example only and that one or more of the locking features 222 and/or the sealing surface 224 may be axially lower than the orientation features 214. In at least one embodiment, the locking features 222 may correspond to grooves or threads, among other options. Furthermore, the sealing surface 224 may correspond to a machined surface that may have a roughness less than a threshold amount to permit sealing against the orientation sleeve. In various embodiments, it should be appreciated that the sealing surface 224 may facilitate a metal-to-metal seal between the THS 208 and the orientation sleeve.

As noted above, in operation the BOP and riser (not shown) may be run and locked to the high pressure housing 204. Thereafter, the well may then be drilled for an intermediate casing string 226 (such a string having a diameter of approximately 13⅜ inches) to be run through the tubing head spool 208 and landed and sealed inside the high-pressure housing 204. In various embodiments, the well is then drilled further for a production casing string 226 (which may have a diameter of approximately 10¾ inches) to be run through the tubing head spool 208 and landed and sealed inside the high-pressure housing 204. For example, the producing casing string 228 may land on top of the intermediate casing string on a spacer hanger. In various embodiments, the well is then drilled for the lower completion, which is done through the tubing head spool 208.

Figure 3:
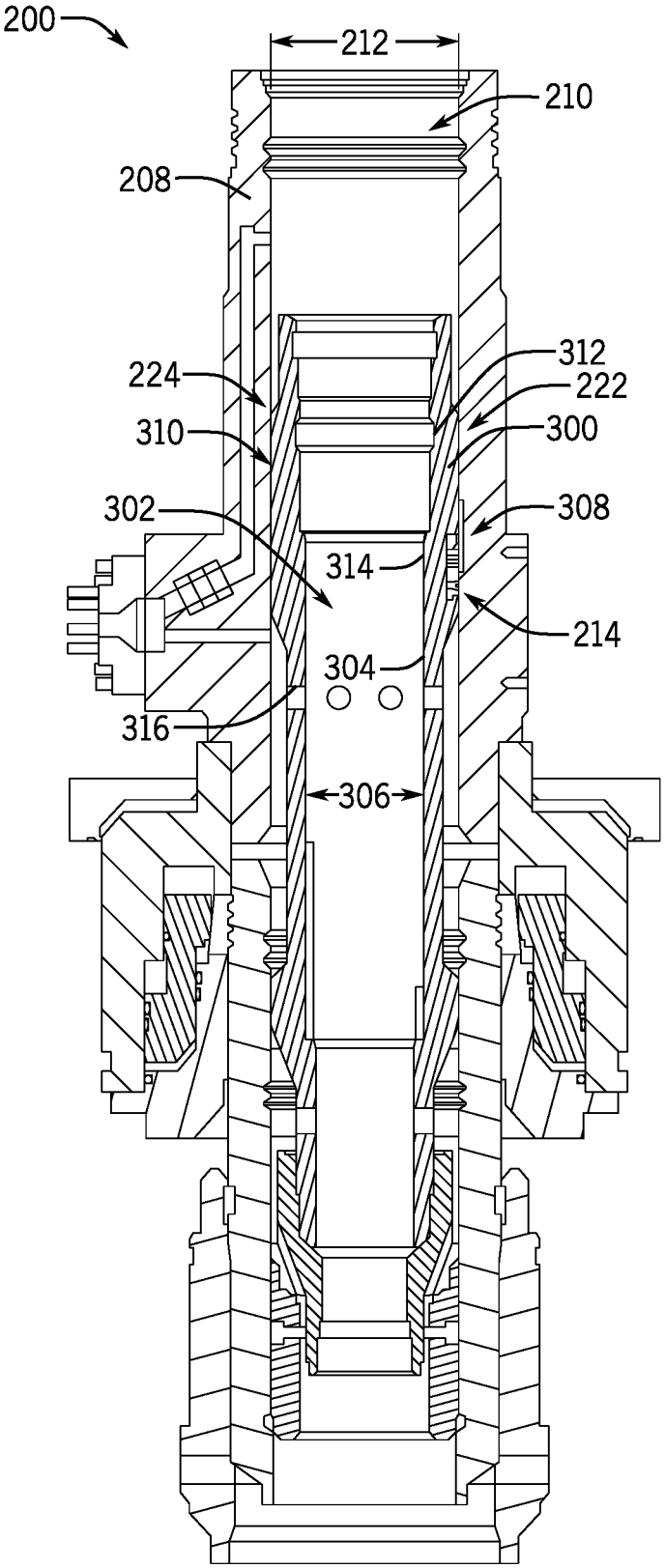
FIG. 3 is a schematic cross-sectional view of an embodiment of a well system, in accordance with embodiments of the present disclosure.

FIG. 3 is a schematic cross-sectional view of an embodiment of the well system 200 further illustrating an orientation sleeve 300 (e.g., sleeve) positioned within the THS 208. In at least one embodiment, after landing the lower completion, the orientation sleeve 300 is run and set in the tubing head spool 208. The orientation sleeve 300 enables a subsequently run tubing hanger to be orientated in a desired position within the body of the tubing head spool 208. Such a configuration may further enable mating of a Subsea Christmas Tree (XT) and hydraulic and electrical connections between the XT and tubing hanger.

In at least one embodiment, the orientation sleeve 300 is a separate component that is run independent of the THS 208. Accordingly, the orientation sleeve 300 may be run and installed after the various casing strings, hangers, various seals, and the lower completion are installed. Furthermore, as noted above, each of these components may be installed through the bore 210 of the THS 208 prior to installation of the orientation sleeve 300, which as will be described may include a smaller bore that does not permit installation of one or more of the components noted herein.

In one or more embodiments, an upper completion is set after the lower completion. For example, an upper completion is set with a tubing hanger landing, orientation, sealing, and locking within the orientation sleeve 300 in the bore 210 of the THS 208. As the tubing hanger lands, it may be oriented by engaging one or more grooves or components on an interior surface of the orientation sleeve 300. In at least one embodiment, the tubing hanger may also include one or more mating features to engage the components of the orientation sleeve 300.

By way of example, in the illustrated embodiment the orientation sleeve 300 includes a sleeve bore 302 having a sleeve surface 304. As shown, the sleeve bore 302 includes a sleeve diameter 306 that is less than the diameter 212 of the THS 208. Accordingly, one or more components that were capable of passing through the bore 210 of the THS 208 may not pass through the bore 302 of the orientation sleeve 300.

Upon installation, one or more engagement features 308 mate with or otherwise engage the orientation features 214 of the THS 208. In at least one example, the engagement features 308 correspond to keys or dogs that protrude outwardly from the orientation sleeve 300. In at least one embodiment, a span (e.g., circumferential span) of the engagement features 308 substantially correspond to a size of the orientation features 214 such that the engagement features 308 extend into the slot or groove that corresponds to the orientation features 214 in the illustrated embodiment. As will be appreciated, the engagement features 308 and/or the orientation features 214 may be particularly positioned at respective circumferential positions such that engagement happens when components are aligned or oriented in a desired position. It should be appreciated that, in various embodiments, the engagement features 308 may not be pressure containing components and may be used for orientation or positioning. However, it should be appreciated that, in various embodiments, the engagement features 308 may be configured as pressure containing components.

In at least one embodiment, the orientation sleeve 300 engages the locking features 222, for example with one or more mating features (not pictured), such as corresponding grooves that interlock or otherwise secure to the locking features 222, which may include helical grooves. In at least one embodiment, the locking features 222 may be a threaded component that engages mating threads on an outer surface of the orientation sleeve 300. In at least one embodiment, a sleeve sealing surface 310 engages or otherwise is meets the sealing surface 224 of the THS 208. In one or more embodiments, the respective sealing surfaces 224, 310 may be smooth or otherwise low-friction surfaces utilized to form a metal-to-metal seal between the orientation sleeve 300 and the THS 208.

Further shown in FIG. 3 is a locking groove 312 positioned at an axially upward position proximate the sealing surface 310. It should be appreciated that such a position is for illustrated purposes only and that various embodiments may position the locking groove 312 at one or more other locations. Furthermore, a single locking groove 312 is also by way of example and more locking grooves 312 may be included, such an axial set of locking grooves. As noted, in various embodiments, a tubing hanger will be positioned within the orientation sleeve 300, which may also include a tubing hanger sealing surface 314 to engage the tubing hanger. In various embodiments, the tubing hanger sealing surface 314 may be a machined or smooth surface with a reduced roughness to facilitate a metal-to-metal seal.

One or more embodiments further include a flow-by port 316 arranged along the orientation sleeve 300. The flow-by port 316 is formed by one or more to allow the annulus to flow into the path/a valve in the THS body and come back into the bore above the tubing hanger, where it will flow into the XT.

Figure 4:
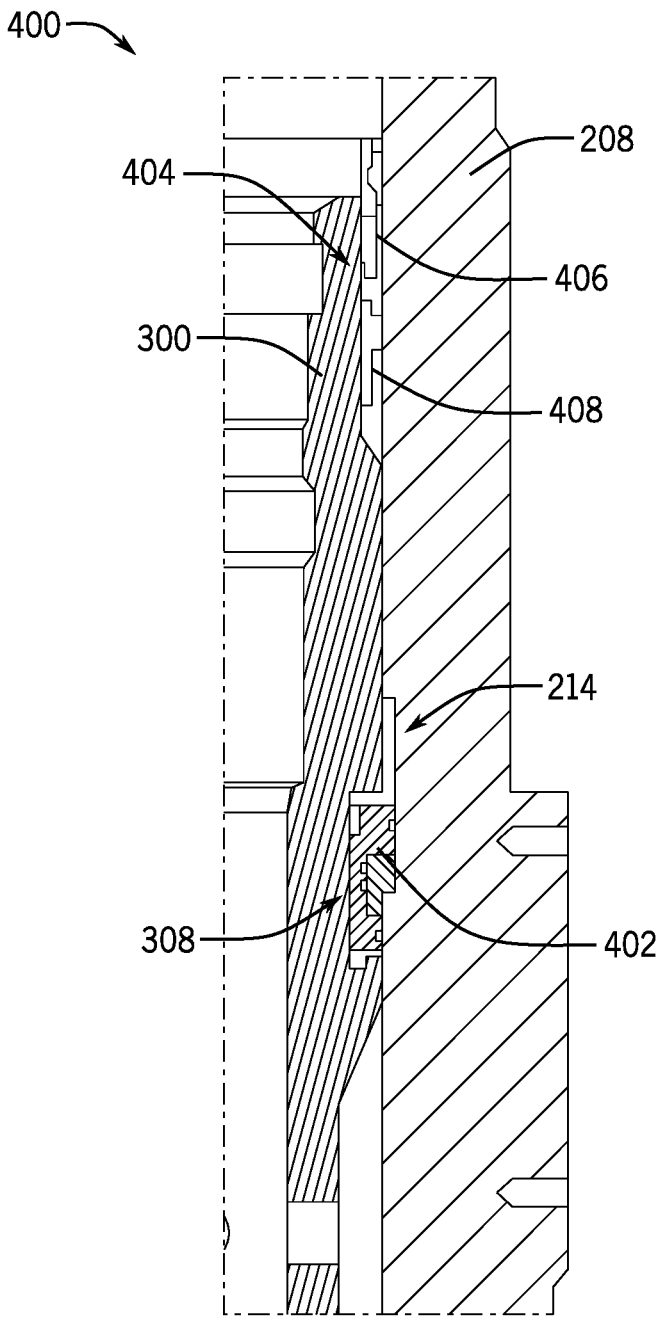
FIG. 4 is a detailed schematic cross-sectional view of an embodiment of an installation configuration, in accordance with embodiments of the present disclosure.

FIG. 4 is a detailed schematic cross-sectional view of an embodiment of a portion of the well system 200 illustrating an installation configuration 400 between the orientation sleeve 300 and the THS 208. As noted above, in various embodiments the orientation sleeve 300 engages the orientation features 214 formed within the THS 208, which illustrates the engagement features 308, shown as a key, engaging a slot. The slot extends into the body of the THS 208 and receives the key, which may then be seated on a shoulder. In one or more embodiments, the engagement features 308 include one or more outwardly extending members 402 that are positioned within the slot. It should be appreciated that the extending members 402 may be spring-loaded or otherwise biased outwardly toward the orientation features 214 such that, upon alignment, the extending members 402 are pushed outwardly to engage the orientation features 214. In at least one embodiment, multiple extending members 402 may be utilized, which may engage individual orientation features 214. In one or more embodiments, a slanted upward surface is arranged on the extending members 402 to facilitate retraction of the extending members 402 responsive to a force.

In at least one embodiment, a sealing assembly 404 is utilized to secure the orientation sleeve 300 to the THS 208. The sealing assembly 404 may include a seal 406 along with a locking device 408. In this example, the seal 406 may engage at least one of the locking features 222 and/or the sealing surface 224. Similarly, the locking device 408 may also engage at least one of the locking features 222 and/or the sealing surface 224. In various embodiments, the sealing assembly 404 is positioned to resist up thrust loads applied to the orientation sleeve 300.

Figure 5:
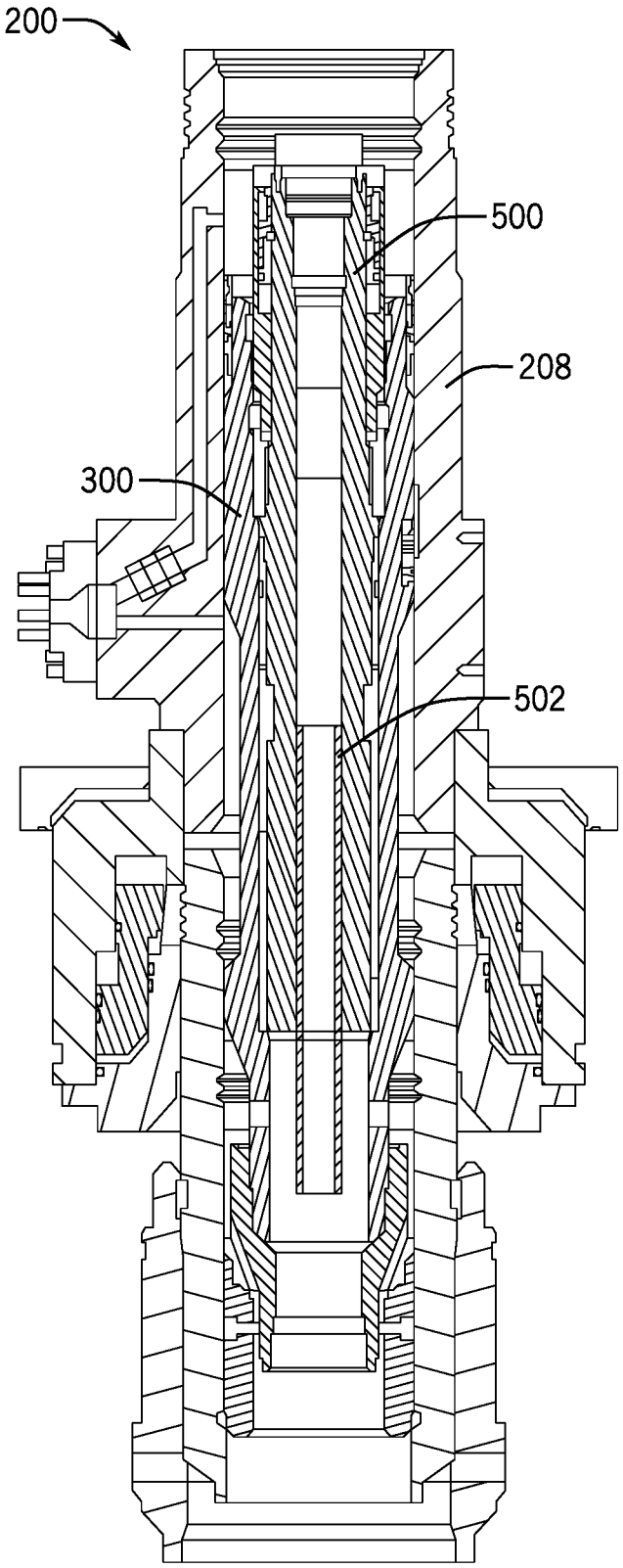
FIG. 5 is a schematic cross-sectional view of an embodiment of a well system, in accordance with embodiments of the present disclosure.

FIG. 5 is a schematic cross-sectional view of an embodiment of the well system 200 wherein a tubing hanger 500 is installed within the orientation sleeve 300. In this example, the tubing hanger 500 is arranged within the bore 302 of the orientation sleeve 300 and engages the sealing surface 314. The tubing hanger 500 is therefore secured within the THS 208 and may receive one or more tubulars 502 for wellbore operations, such as completion operations.

Figure 6:
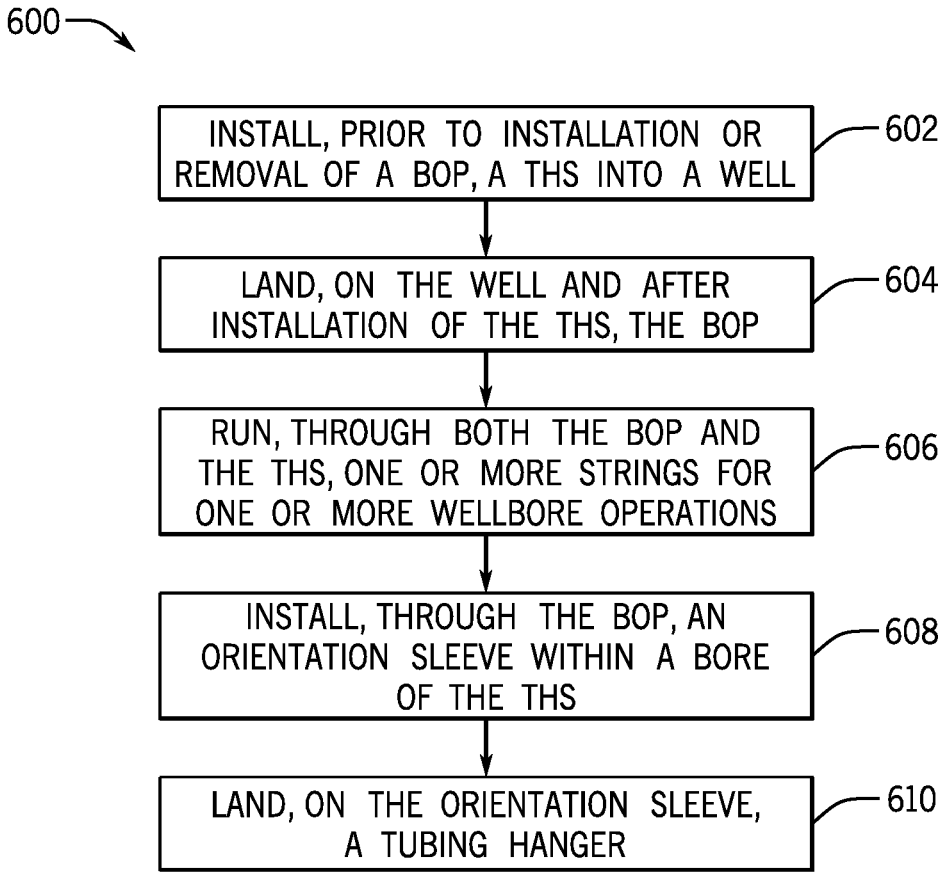
FIG. 6 is a flow chart of an embodiment of a method for performing a wellbore operation, in accordance with embodiments of the present disclosure.

FIG. 6 is a flow chart of an embodiment of a method 600 for conducting one or more downhole operations. It should be appreciated for this method, and all methods described herein, that there may be more or fewer steps. Moreover, the steps may be conducted in a different order, or in parallel, unless otherwise specifically stated. In this example, a THS is installed on a well 602. In various embodiments, the THS is installed prior to installation or removal of a BOP. That is, the THS may be installed before one or more operations are conducted through the BOP. In at least one embodiment, the BOP is landed on the well 604. The BOP may be landed after installation of the THS. In at least one embodiment, one or more strings are run through both the BOP and the THS to conduct one or more wellbore operations 606, such as a drilling operation, among other options. In various embodiments, the THS has a sufficient inner diameter to facilitate operations. In at least one embodiment, an orientation sleeve is installed within the THS 608. The orientation sleeve may be run through the BOP. In at least one embodiment, a tubing hanger is landed on the orientation sleeve 610. The tubing hanger may then support one or more tubulars for additional wellbore operations, such as completions.

Figure 7:
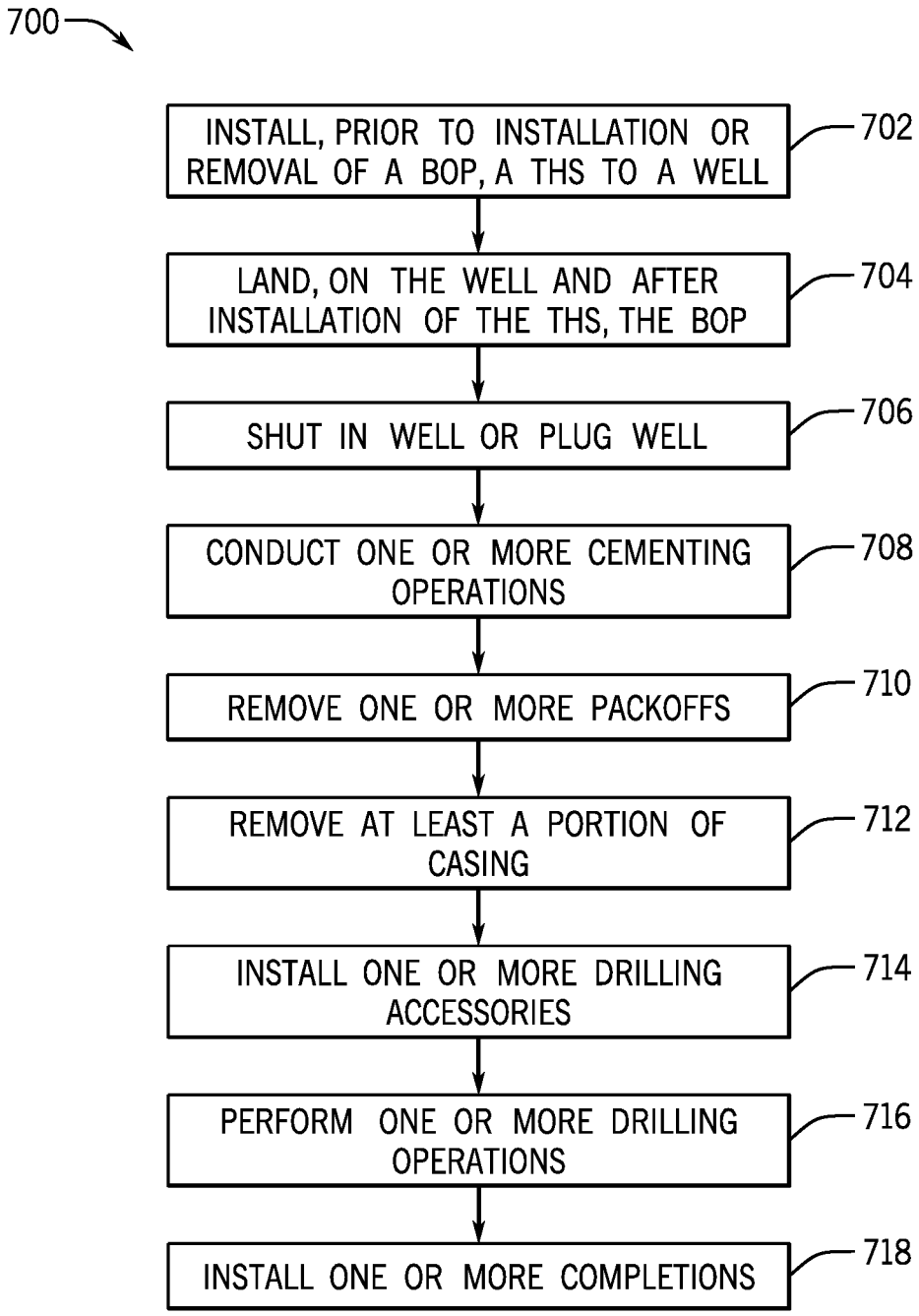
FIG. 7 is a flow chart of an embodiment of a method for performing a wellbore operation, in accordance with embodiments of the present disclosure.

FIG. 7 is a flow chart of an embodiment of a method 700 for conducting one or more downhole operations. In this example, a THS is installed on a well 702. In various embodiments, the THS is installed prior to installation or removal of a BOP. That is, the THS may be installed before one or more operations are conducted through the BOP. In at least one embodiment, the BOP is landed on the well 704. The BOP may be landed after installation of the THS. In at least one embodiment, the well is killed or otherwise shut in and tubing is pulled 706. Thereafter, one or more cementing operations may be conducted 708, such as cementing barriers in production casing.

In at least one embodiment, after cementing operations, one or more packoffs are removed 710, such as a casing hanger packoff. Removal of the packoff may enable further operations, such as removal of casing 712. In at least one embodiment, casing is cut, for example above the cement barriers added during the cementing operations. Thereafter, a drilling accessory is installed 714, such as whipstock to enable drilling along a new branch. The whipstock may include one or more slanted or deviated paths to direct a drill string away from the previously formed wellbore. Thereafter, one or more drilling operations may commence 716 and additional completions may be installed for recovery 718.

The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A wellbore system, comprising:

a tubing head spool (THS) having a THS bore, the THS bore being a full access bore having a first diameter to facilitate passage of one or more wellbore components;

a blowout preventer (BOP) associated with and upstream of the THS, the BOP being installed after the THS and without plugging a well prior to installation, the BOP having a BOP bore with a second diameter, the second diameter being greater than or equal to the first diameter, and the BOP bore being a full access bore permitting passing of the one or more wellbore components; and an orientation sleeve having an outer body with a third diameter that is less than both the first diameter and the second diameter, the orientation sleeve arranged within the THS and installed through the BOP, the orientation sleeve having at least one engagement feature, configured to extend radially outward from the third diameter, that interacts with at least one orientation feature formed along the THS bore, the at least one orientation feature positioning the orientation sleeve in a predetermined configuration.

2. The wellbore system of claim 1, further comprising:

a tubing hanger installed, through the BOP, within the orientation sleeve, the tubing hanger being secured, at least in part, by one or more locking grooves formed in the orientation sleeve.

3. The wellbore system of claim 1, wherein the at least one engagement feature includes at least a seal and a locking device, the locking device securing the orientation sleeve to locking features formed along the THS bore.

4. The wellbore system of claim 3, wherein the locking features are helical grooves.

5. The wellbore system of claim 1, wherein the at least one orientation feature includes at least one slot having a fourth diameter extending into a body of the THS, the fourth diameter being greater than the first diameter.

6. The wellbore system of claim 1, further comprising:

a flow by port formed within the orientation sleeve, the flow by port permitting flow into an annulus.

7. The wellbore system of claim 1, further comprising:

one or more tools associated with one or more drilling operation extending through both the THS and the BOP.

8. The wellbore system of claim 7, wherein the one or more drilling operations correspond to a side track option and the one or more tools associated with the side track option includes at least a drill bit.

9. A method, comprising:

installing, prior to installation of a blowout preventer (BOP), a tubing head spool (THS), the THS having first inner diameter larger than or equal to a second inner diameter of the BOP;

landing, on a well after installation of the THS, the BOP;

running, through both the THS and the BOP, one or more strings to conduct a wellbore operation;

installing, through the BOP, an orientation sleeve within the THS, the orientation sleeve having a body outer diameter that is less than both the first inner diameter and the second inner diameter; and landing, through the BOP, a tubing hanger.

10. The method of claim 9, further comprising:

engaging, via one or more engagement features of the orientation sleeve, one or more orientation features formed along a bore of the THS, the one or more orientation features positioning the orientation sleeve in a predetermined alignment configuration.

11. The method of claim 9, further comprising:

securing, via a sealing assembly, the orientation sleeve to the THS, the sealing assembly having a seal and a locking device that engages locking features formed on a bore of the THS.

12. The method of claim 9, further comprising:

redirecting a flow, through the orientation sleeve, into a flow by port formed along the orientation sleeve.

13. The method of claim 9, further comprising:

cutting a portion of casing within the well, the portion of casing being uphole of a cemented region;

installing, through the BOP and THS, one or more drilling accessories; and performing one or more drilling operations using the one or more drilling accessories.

14. The method of claim 13, wherein the one or more drilling operations correspond to a side track option, further comprising:

installing, through the BOP and the THS, one or more completions into a wellbore formed via the one or more drilling operations.

15. The method of claim 9, wherein the well is not plugged or shut in prior to installation of the THS.

16. A system, comprising:

a tubing head spool (THS) installed in a non-plugged wellbore, the THS having a first bore with a first diameter to permit passage of one or more wellbore components that also pass through an associated blowout preventer (BOP) having a second bore with a second diameter; and an orientation sleeve arranged within the THS, the orientation sleeve being positioned and aligned within the THS via one or more engagement features mating with one or more orientation features within the first bore, wherein the orientation sleeve has an outer diameter that permits passages through both the first diameter and the second diameter.

17. The system of claim 16, further comprising:

a tubing hanger installed, through the BOP, within the orientation sleeve, the tubing hanger being secured, at least in part, by one or more locking grooves formed in the orientation sleeve.

18. The system of claim 16, wherein the one or more engagement features include at least a seal and a locking device, the locking device securing the orientation sleeve to locking features formed along the bore.

19. The system of claim 16, wherein the one or more orientation features include at least one slot extending into a body of the THS.

20. The system of claim 19, wherein the one or more orientation features are positioned at a predetermined location along the bore to align the orientation sleeve.

* * * * *